US005882734A

United States Patent [19]

Blum et al.

[11] Patent Number: 5,882,734

[45] Date of Patent: Mar. 16, 1999

[54] MULTILAYER LACQUERING PROCESS

[75] Inventors: Joachim Blum, Remscheid; Dieter Stranghöner, Sprockhövel; Dieter Engel; Klausjörg Klein, both of Wuppertal; Walter Kühhirt, Remscheid; Matthias Kimpel; Friedrich-Ludwig Siever, both of Schwelm, all of Germany

[73] Assignee: Herberts Gesellschaft Mit Beschrankter Haftung, Wuppertal, Germany

[21] Appl. No.: 952,728

[22] PCT Filed: May 24, 1996

[86] PCT No.: PCT/EP96/02234

§ 371 Date: Nov. 25, 1997

§ 102(e) Date: Nov. 25, 1997

[87] PCT Pub. No.: WO96/38235

PCT Pub. Date: Dec. 5, 1996

[30] Foreign Application Priority Data

May 30, 1995 [DE] Germany ..... 19519665.1

[51] Int. Cl.[6] ..... B05D 1/38; B05D 3/02; B05D 7/26

[52] U.S. Cl. ..... 427/407.1; 427/195; 427/379; 427/409; 427/458

[58] Field of Search ..... 427/407.1, 409, 427/410, 458, 379, 380, 195

[56] References Cited

U.S. PATENT DOCUMENTS

| | | | |
|---|---|---|---|
| 3,674,671 | 7/1972 | Stromberg | 204/181 |
| 4,755,418 | 7/1988 | DebRoy et al. | 427/409 |
| 4,882,090 | 11/1989 | Batzill et al. | 252/511 |
| 4,911,811 | 3/1990 | Mullaney, Jr. | 427/409 |
| 4,933,214 | 6/1990 | Sugiura et al. | 427/379 |
| 5,114,756 | 5/1992 | Mirabeau et al. | 427/379 |
| 5,203,975 | 4/1993 | Richardson | 204/181.1 |
| 5,389,406 | 2/1995 | Doebler et al. | 427/407.1 |
| 5,395,659 | 3/1995 | Graf et al. | 427/407.1 |
| 5,425,970 | 6/1995 | Lahrmann et al. | 427/493 |
| 5,507,928 | 4/1996 | Bohmert et al. | 204/488 |
| 5,721,018 | 2/1998 | Goldner et al. | 427/407.1 |

FOREIGN PATENT DOCUMENTS

| | | |
|---|---|---|
| 0 402 181 | 12/1990 | European Pat. Off. . |
| 0 426 327 | 5/1991 | European Pat. Off. . |
| 0 548 845 | 6/1993 | European Pat. Off. . |
| 2 335 270 | 7/1977 | France . |
| 2 129 807 | 5/1984 | United Kingdom . |
| WO86/03791 | 7/1986 | WIPO . |
| WO91/12899 | 9/1991 | WIPO . |

*Primary Examiner*—Diana Dudash
*Attorney, Agent, or Firm*—Pillsbury Madison & Sutro LLP

[57] ABSTRACT

In a process for producing a multilayer lacquer coating, eg for motor vehicles, a first coating layer of an aqueous coating agent (1) is electrophoretically applied on to an electrically conductive substrate and is then stoved. As the coating agent (I), a coating agent which, in the stoved state, will produce an electrically conductive coating layer is used. An electrically insulating second coating layer of an aqueous coating agent (II), which differs from (I), is electrophoretically deposited and stoved. A third basic lacquer coating layer of a colour-giving and/or effect-producing coating agent is applied, and a fourth transparent coating layer of a clear lacquer coating agent is applied, the last-mentioned two coats being stoved together. One or more further transparent coating layers may be applied.

6 Claims, No Drawings

MULTILAYER LACQUERING PROCESS

This is the national phase of international application PCT/EP96/02234, filed 24 May 1996 which designated the U.S.

The invention relates to a process for preparing a multilayer lacquer coating for conductive, in particular metallic, substrates which is particularly well suited for the lacquer-coating of motor vehicles.

Present-day high-grade lacquers for the assembly-line lacquering of motor vehicles generally comprise an electrophoretically applied anticorrosive primer and subsequent coats which are then applied by spraying and comprise a filler layer and a subsequent layer which is applied for decorative purposes and consists of a colour-giving and/or effect-producing base coat, and a protective clear lacquer coat which seals the surface.

The overall thickness of such motor vehicle lacquers is, in practice, between 90 and 130 μm which is the total produced by a layer thickness of 15 to 25 μm for the primer, 30 to 40 μm for the filler layer, 10 to 25 μm for the base lacquer coat and 30 to 40 μm for the clear lacquer coat. These layer thicknesses are far greater when it is intended to produce lacquer coatings which have a particularly good optical appearance, i.e. with a prominent lustre and coating lacquer condition, for example, when lacquer-coating motor vehicles in the upper and luxury classes. The application of a plurality of clear lacquer coats on to a base lacquer coat is described, for example, in DE-A-42 15 070 and DE-A-38 39 905. In such cases, layer thicknesses exceeding 110 μm, for example up to 170 μm, are produced, but this is undesirable for reasons relating to savings in the materials used and to reduction of the mass of the finished vehicle.

The object of the invention is to provide multilayer lacquer coatings, in particular motor vehicle lacquers, which meet the requirements with regard to a prominent lustre and coating lacquer condition, without exceeding the standard measure for overall layer thicknesses for motor vehicle lacquer coatings, and without any concomitant disadvantages in the overall level of properties.

It has been found that it was possible to meet this object in a novel manner according to the invention by a process for producing a multilayer lacquer coating, whereby a first coating layer of an electrophoretically depositable aqueous coating agent (1) is electrophoretically applied on to an electrically conductive substrate and is then stoved, whereupon further coating layers are applied, according to which process, as the coating agent (I), a coating agent which, in the stoved state, will produce an electrically conductive coating layer is used, whereupon, after stoving of the first coating layer, an electrically insulating second coating layer of an electrophoretically depositable aqueous coating agent (II), which differs from (I), is electrophoretically deposited and stoved, whereupon, as a third coating layer, a base lacquer coat of a colour-giving and/or effect-producing coating agent is applied, and a fourth transparent coating layer of a clear lacquer coating agent is applied, the last-mentioned two coats being stoved together, whereupon one or more further transparent coating layers are optionally applied, the overall dry layer thickness of the lacquer structure being between 90 and 130 μm, preferably less than 110 μm, and the dry layer thickness of the transparent coating layer or the overall layer thickness of the transparent coating layers being between 40 and 80 μm, preferably between 50 and 60 μm. When a plurality of clear lacquer coats is applied, these coats may be provided by the same or by different clear lacquer coating agents.

In the process according to the invention, it is possible to use, as the electrophoretically depositable but different coating agents (I) and (II), anodically or cathodically depositable electro-dipcoats (ETL), which are known per se, to produce the first and the second coating layer, it being imperative that the electrophoretically depositable coating agent (I) contain components which give an adequately low specific resistance to the first coating layer, in the stoved state, for the electrophoretic depositing of a further coating layer of an electrophoretically depositable coating agent (II) which differs from (I).

The coating agents (I) and (II) are aqueous coating agents having a solids content of, for example, 10 to 20% by mass. This solids content comprises the usual binding agents, at least a part of the binding agents containing ionic substituents and/or substituents which may be converted into ionic groups, and, if required, groups which are capable of chemical cross-linking, and, optionally, any cross-linking agents which are present, electrically conductive components, filler substances, pigments and the usual additives for lacquers.

The ionic groups or the groups which are capable of being converted into ionic groups in the binding agents may be anionic groups or groups which may be converted into anionic groups, acid groups, such as —COOH, —$SO_3H$ and/or —$PO_3H_2$, and the corresponding anionic groups neutralized with bases. They may also be cationic groups, or groups which are capable of being converted into cationic groups, e.g. basic groups, preferably nitrogenous basic groups; these groups may be present in quaternary form, or they may be converted into ionic groups using a usual neutralizing agent, e.g. an organic monocarboxylic acid, such as, for example, formic acid or acetic acid. Examples are amino groups, ammonium groups, e.g. quaternary ammonium, phosphonium and/or sulphonium groups.

In the process according to the invention, to produce the first and/or second coating layers, it is possible to use, for example, the usual anodically depositable electro-dipcoat binding agents and lacquers (ATL) containing anionic groups. Examples hereof are described in DE-A-28 24 418. They include, for example, binding agents based on polyesters, epoxy resin esters, (meth)acrylic copolymer resins, maleinate oils or polybutadiene oils, with an average molecular weight (Mw) of, for example, 300–10000, and an acid number of 35–300 mg KOH/g. The binding agents contain —COOH, —$SO_3H$ and/or —$PO_3H_2$ groups. The resins can be reduced to the aqueous phase after neutralization of at least a part of the acid groups. The binding agents may be self-crosslinking or they may require an additional crosslinker. Accordingly, it is also possible for the lacquers to contain the usual cross-linking agents, e.g. triazine resins, cross-linking agents which contain groups capable of transesterification or blocked polyisocyanates.

It is also possible to use the usual cathodic electro-dipcoat lacquers (KTL) based on cationic or basic binding agents in the process according to the invention to produce the first and/or the second coating layer. Such basic resins are, for example, resins containing primary, secondary and/or tertiary amino groups, the amine values of which are, for example, in the range from 20 to 250 mg KOH/g. The average molecular weight (Mw) of the basic resins is preferably from 300 to 10000. Examples of such basic resins are amino(meth)acrylate resins, amino epoxy resins, amino epoxy resins with terminal double bonds, amino epoxy resins with primary OH groups, amino polyurethane resins, polybutadiene resins containing amino groups, or modified epoxy resin carbon dioxide/amine conversion products. These base resins may be self-crosslinking or they are used in mixtures with known cross-linking agents. Examples of such cross-linking agents are aminoplastic resins, blocked polyisocyanates, cross-linking agents with terminal double bonds, polyepoxide compounds or cross-linking agents which contains groups which are capable of transesterification.

Examples of base resins and cross-linking agents which may be used for cathodic dipcoating (KTL) baths are described in EP-A-0 082 291, EP-A-0 234 395, EP-A-0 227 975, EP-A-0 178 531, EP-A-0 333 327, EP-A-0 310 971, EP-A-0 456 270, U.S. Pat. No. 3,922,253, EP-A-0 261 385, EP-A-0 245 786, DE-A-33 24 211, EP-A-0 414 199, EP-A-0 476 514. These resins may be used singly or in mixtures thereof. With particular preference, so-called "non-yellowing" KTL systems, in which a yellowing or discoloration of the multilayer lacquers produced according to the process according to the invention is prevented during stoving, are used. By way of example, these are KTL systems which cross-link by means of specially selected blocked polyisocyanates, as described, for example, in EP-A-0 265 363.

The electro-dipcoat (ETL) coating agent (I) contains components which impart electrical conductivity. Said components are intended to give the first coating layer, in the stoved state, a sufficiently low specific resistance, for example between $10^3$, and $10^8$ Ohm.cm, for the electrophoretic deposition of a further coating layer of an electrophoretically depositable coating agent (II). Examples of these components are particulate inorganic or organic electric conductors or semiconductors, such as, for example, iron oxide black, graphite, conductive carbon black, metal powder, for example, from aluminium, copper or special steel, molybdenum disulphide or also polymers having electrical conductivity, e.g. preferably polyaniline. Examples of electro-dipcoat lacquers which contain these components and which may be used according to the invention are set out in U.S. Pat. No. 3,674,671, GB 2 129 807, EP-A-0 409 821 and EP-A-0 426 327. The components imparting electrical conductivity are contained in the ETL coating agent (I) in a quantity such that the desired specific resistance of the deposited coating layer is achieved in the stoved state. Relative to the solids content of the ETL coating agent (I), the quantity of the component or components imparting electrical conductivity is, for example, between 1 and 30% by mass. The quantity is readily determined by the person skilled in the art; it is, for example, dependent on the relative density, the specific electrical conductivity and the particle size of the components used for imparting electrical conductivity. One or a combination of more such components may be used.

In addition to the base resins and the optionally present cross-linking agents, and the components which are contained in the ETL coating agent (I) and impart electrical conductivity to the first coating layer in the stoved state, it is possible for the ETL coating agents (I) and (II) to contain pigments, filler substances and/or the usual additives for lacquers. The pigments include, for example, the usual inorganic and/or organic colour pigments and/or filler substances. Examples hereof are titanium dioxide, iron oxide pigments, phthalocyanine pigments, quinacridone pigments, kaolin, talcum, silicon dioxide or coarse coal as a black pigment, fine-particled carbon black obtained by incomplete combustion, coarse-particled carbon black obtained by catalytic or thermal decomposition of liquid or gaseous hydrocarbons.

It is possible for the pigments to be dispersed to form pigment pastes, e.g. using known paste resins. Such resins are well known to the person skilled in the art. Examples of paste resins which may be used in KTL baths are described in EP-A-0 183 025 and in EP-A-0 469 497.

The additives include the usual additives such as those which are, in particular, known for ETL coating agents. Examples hereof are wetting agents, neutralizing agents, levelling agents, catalysts, corrosion inhibitors, antifoam additives, solvents, but, in particular, also light-protection agents, optionally in combination with anti-oxidant agents.

In the process according to the invention, it is preferred to use a KTL coating agent as the ETL coating agent (I), and an ATL coating agent as the ETL coating agent (II).

In the process according to the invention, known colour-giving and/or effect-producing base lacquer coating agents, such as those used to produce base lacquer/clear lacquer double-layer lacquer coatings, large numbers of which are described in the patent literature, are used for producing the third coating layer.

The base lacquers which may be used according to the invention for producing the third coating layer may dry physically or they may cross-link with the formation of covalent bonds. The base lacquers which cross-link with the formation of covalent bonds may be self-crosslinking systems or they may require an additional crosslinker.

The colour-giving and/or effect-producing base lacquers which may be used in the process according to the invention are liquid coating agents. These may include single-component or multi-component coating agents, but single-component agents are preferred. They may include systems based on organic solvents or, preferably, aqueous base coats, the binding agent systems of which are stabilized in a suitable manner, e.g. anionically, cationically or non-ionically.

The base lacquer coating agents, which may be used in the process according to the invention for producing the third coating layer, include the usual lacquer systems which contain one or more of the usual base resins as the film-forming binding agents. In the event that the base resins are not self-crosslinking or self-drying, they may optionally also contain cross-linking agents. No restrictions are imposed on the base resin component or on the component of cross-linking agent. As the film-forming binding agents (base resins), it is possible, for example, to use polyester, polyurethane and/or (meth)acrylic copolymer resins. In the event of the preferred aqueous base coats, polyurethane resins are preferably contained, and particularly preferably at least in a quantity of 15% by mass, relative to the solid resin content of the aqueous base coat. The selection of the optionally contained cross-linking agents is non-critical, and depends on the functionality of the base resin, i.e. the cross-linking agents are selected such that they have a reactive functionality which is complementary to the functionality of the base resin. Examples of such complementary functionalities between the base resin and the cross-linking agents are: hydroxyl/methylol ether, hydroxyl/free isocyanate, hydroxyl/blocked isocyanate, carboxyl/epoxide. In so far as they are compatible, it is also possible for a plurality of such complementary functionalities to be present in parallel in a base lacquer. The cross-linking agents which are optionally used in the base lacquers may be present singly or in mixtures thereof.

In addition to the usual physically drying and/or chemically cross-linking binding agents, the base lacquers used in the process according to the invention also contain inorganic and/or organic coloured pigments and/or effect pigments, e.g. titanium dioxide, iron oxide pigments, carbon black, azo pigments, phthalocyanine pigments, quinacridone pigments, metal pigments, e.g. of titanium, aluminium or copper, interference pigments, such as, for example, titanium dioxide-coated aluminium, coated mica, graphite-effect pigments, plate-like iron oxide, plate-like copper phthalocyanine pigments, and effect-producing pigments which develop a strong colour flop in particular on dark backgrounds. Examples of such effect-producing pigments are described in EP-A-0 358 208, EP-A-0 383 376, EP-A-0 601 483, EP-A-0 686 674, EP-A-0 688 833, U.S. Pat. No. 4,434,010, WO 95 17 480, WO 95 32 247, WO .95 32 248. Base lacquers containing effect-producing pigments of this kind are preferably applied on to dark, particularly preferably on to black, double-layer multilayer lacquer coats produced by electro-dipcoating.

In addition, the base lacquers may contain the usual additives for lacquers, such as, for example, filler substances, catalysts, levelling agents, anti-dimpling agents or, in particular, light-protection agents, optionally together with anti-oxidant agents.

Examples of solvent-based base lacquer systems which may be used in the process according to the invention are set out in DE-A-37 15 254, DE-A-39 13 001, DE-A-41 15 948, DE-A-42 18 106, EP-0 289 997 and WO-91 00 895.

Examples of aqueous base coat systems which may be used in the process according to the invention are given in DE-A-29 26 584, DE-A-36 28 124, DE-A-38 41 540, DE-A-39 03 804, DE-A-39 15 459,(DE-A-40 01 841, DE-A-40 09 857, DE-A-40 11 633, DE-A-41 07 136, DE-A-41 22 266, EP-A-0 089 497, EP-A-0 226 171, EP-A-0 228 003, EP-A-0 287 144, EP-A-0 297 576, EP-A-0 301 300, EP-A-0 353 797, EP-A-0 354 261, EP-A-0 401 565, EP-A-0 424 705, EP-A-0 512 524 and EP-A-0 584 818.

It is preferred that the electro-dipcoat used to produce the second coating layer have a shade of colour which is closely similar to or the same as the base lacquer used to produce the third coating layer. Within the framework of the present invention, it is preferable that the term 'closely similar colour shades' is understood to mean that the colour difference, which comprises the brightness difference, the chromotoning difference and the saturation difference, and is determined between the colour shades while, in each case, the lacquer coating is opaque and the measuring geometry is (45/0°), between the second and the third coating layers does not exceed an n-fold $\Delta E^*$(CIELAB) value, the $\Delta E^*$ (CIELAB) reference value being that value which results for the colour shade of the third coating layer from the CIE-x, y-diagram (chromaticity diagram), which is known to the person skilled in the art, in accordance with DIN 6175, and wherein the following relationship applies:

$n < 90$ in the region of the CIE-x,y-diagram marked with $\Delta E^* = 0.3$
$n < 50$ in the region of the CIE-x,y-diagram marked with $\Delta E^* = 0.5$
$n < 40$ in the region of the CIE-x,y-diagram marked with $\Delta E^* = 0.7$
$n < 30$ in the region of the CIE-x,y-diagram marked with $\Delta E^* = 0.9$.

As the clear lacquer coating agent for producing the fourth and, if required, any additional coating layers, all the usual clear lacquers or transparent coloured or colourless pigmented coating agents are, in principle, suitable. These may include single-component or multi-component clear lacquer coating agents. They may be solvent-free (liquid, or in the form of clear lacquer powder), or they may be solvent-based systems or they may be water-dilutable clear lacquers, the binding agent systems of which are stabilized in a suitable manner, e.g. anionically, cationically or non-ionically. The water-dilutable clear lacquer systems may be systems which are water-soluble or dispersed in water, for example emulsion systems or powder slurry systems. The clear lacquer coating agents harden during stoving, while forming covalent bonds as a result of chemical cross-linking.

The clear lacquers which may be used in the process according to the invention include the usual clear lacquer coating agents which contain one or more of the usual base resins as film-forming forming binding agents. In the event that the base resins are not self-crosslinking, they may optionally also contain cross-linking agents. No restrictions are imposed on the base resin component or on the component of cross-linking agent. Polyester, polyurethane and/or (meth)acrylic copolymer resins may, for example, be used as the film-forming binding agents (base resins). The selection of the optionally contained cross-linking agents is non-critical, said selection depending on the functionality of the base resin, i.e. the cross-linking agents are selected such that they have a reactive functionality which is complementary to the functionality of the base resins. Examples of such complementary functionalities between the base resin and the cross-linking agent are: carboxyl/epoxide, hydroxyl/methylol ether directly bonded to carbon or silicon, hydroxyl/free isocyanate directly bonded to carbon or silicon, hydroxyl/blocked isocyanate directly bonded to carbon or silicon, and a (meth)acryloyl/CH acid group. In this connection, the term 'hydroxyl groups directly bonded to silicon' is also understood to include latent silanol groups, e.g. alkoxy silane groups. In so far as they are compatible, it is also possible for a plurality of such complementary functionalities to be present in parallel in a clear lacquer. The cross-linking agents optionally used in the clear lacquers may be present singly or in mixtures thereof.

In addition to the chemically cross-linking binding agents and, optionally, the cross-linking agents, it is possible for the clear lacquers which may be used in the process according to the invention to contain the usual additives for lacquers, such as, for example, catalysts, levelling agents, dyes, but in particular rheology-controlling agents, such as microgels, NAD's (= non-aqueous dispersions), di-substituted ureas ("sagging control agents"), as well as light-protection agents, optionally in combination with anti-oxidant agents.

Examples of single-component (1K) and two-component (2K) non-aqueous clear lacquer systems, which may be used as the clear lacquer in the process according to the invention, are given in DE-A-38 26 693, DE-A-40 17 075, DE-A-41 24 167, DE-A-41 33 704, DE-A-42 04 518, DE-A-42 04 611, EP-A-0 257 513, EP-A-0 408 858, EP-A-0 523 267, EP-A-0 557 822, WO-92 11 327.

Examples of single-component (1K) or two-component (2K) water-based clear lacquer systems, which may be used as the clear lacquer in the process according to the invention, are given in DE-A-39 10 829, DE-A-40 09 931, DE-A-40 09 932, DE-A-41 01 696, DE-A-41 32 430,. DE-A-41 34 290, DE-A-42 03 510, EP-A-0 365 098, EP-A-0 365 775, EP-A-0 496 079, EP-A-0 546 640.

Examples of the clear lacquer powder systems preferably used for producing the transparent coating layer in the process according to the invention are set out in EP-A-0 509 392, EP-A- 0 509 393, EP-A-0 522 648, EP-A-0 544 206, EP-A-0 555 705, DE-A-42 22 194, DE-A-42 27 580.

It is possible for the transparent coat to be applied in a single coat or in the form of a plurality of coats of the same or of a plurality of different transparent coating agents. It is, however, expedient for the transparent coating layer to be applied as the fourth coat and comprising only one clear lacquer coating agent. In this regard, it is preferable to use clear lacquer coating agents which have the lowest possible run-off tendency, for example clear lacquers which have a high solids content and a correspondingly adjusted rheological behaviour. Clear lacquer powders are particularly preferred.

Electrically conductive materials, such as, for example, metals, are well suited as the substrate for the process according to the invention. Particularly suitable are, for example, car bodies or parts thereof; they may be of pretreated or of untreated metal, or of electrically conductive plastics material, or of a plastics material provided with an electrically conductive coat. The first coating layer, comprising the aqueous coating agent (I) is electrophoretically deposited on to these substrates in the usual manner in a dry layer thickness of, for example, 5 to 15 $\mu$m, and then stoved, for example at temperatures of between 130° and 1800° C.

On to the resultant substrate, which is provided with an ETL coat which has a specific resistance of,. in particular, $10^3$ to $10^8$ Ohm.cm, is applied the electrophoretically depositable second coating layer, comprising the second coating agent (II), which is different from (I), in a dry layer thickness of, for example, 5 to 35 $\mu$m, preferably 10 to 25 $\mu$m, and is then also stoved, for example at temperatures of between 130° and 180° C. The second coating layer is generally not electrically conductive, i.e. in the stoved state, it has a specific resistance generally in excess of $10^9$ Ohm.cm.

The coating obtained from the coating agent (I) as a result of electro-dipcoating serves, in particular, as a protection against any chemical or corrosive attack, with the result that it is advantageous for the entire surface of a three-dimensional substrate, for example a car body, to be coated.

The coating which is obtained from the coating agent (II) as a result of electro-dipcoating and is electrically insulating in the stoved state may extend, but need not extend, across the entire surface of the three-dimensional substrate; accordingly, a possible double-coating comprises a first coating, covering the entire surface, in electro-dipcoating of a first coating agent (I) and a coat comprising the coating agent (II) by electro-dipcoating, for example, essentially only on the outer regions, in particular the visible surfaces of a three-dimensional substrate, i.e. for example not in narrow hollow spaces of a car body.

The above operation is followed by the spray-application of the third coating layer comprising the colour-giving and/or effect-producing base lacquer in a dry layer thickness of 10 to 25 $\mu$m, which thickness is dependent on the shade of colour, for example by compressed-air spraying, airless-spraying or ESTA high-rotation spraying.

Following on the application of the third colour-giving and/or effect-producing coating layer, and after a brief ventilation phase, e.g. at 20° to 80° C., the clear lacquer is applied in a wet-in-wet process. The fourth coating layer of the usual liquid clear lacquer or a clear lacquer powder (in that instance, the application will be in a dry-in-wet process) is applied and the item is then stoved together with the third coating layer, for example at temperatures from 80° to 160° C. It is, optionally, possible for additional layers of clear lacquer, comprising the same or different clear lacquer coating agents, to be applied. According to the invention, the applications are controlled such that the layer thickness of the transparent coating layer or the overall layer thickness of the transparent coating layers is between 40 and 80 $\mu$m, preferably between 50 and 60 $\mu$m.

It is also possible, although not necessarily preferred, for the colour-giving and/or effect producing base lacquer layer to be applied on to the non-stoved second coating layer in a wet-in-wet process, and for the two coating layers then to be stoved jointly prior to or after the application of the transparent coating layer or layers.

It is also possible to achieve good results when, instead of the base lacquer/clear lacquer structure, a coating layer of a pigmented covering lacquer powder is applied on to the double-layer lacquer coating produced from the coating agents (I) and (II), in a layer thickness of 40 to 90 $\mu$m, preferably 50 to 80 $\mu$m, and is then stoved, this possibly being followed by the application of one or more clear lacquer layers. In this regard, the covering lacquer powder is based on a known clear lacquer powder binding agent/cross-linking system, as already described above, for example, in connection with clear lacquer powders. The covering lacquer powder contains colour-giving and/or effect-producing pigments such as those described above by way of example for the base lacquers.

The process according to the invention makes it possible to produce multilayer lacquer coatings, in particular lacquer coatings for motor vehicles with an overall level of properties which is comparable to the state of the art and with an improved lustre and condition of the covering lacquer. It has been found that excellent properties are achieved by the process according to the invention, although said process makes it possible to dispense with the usual sprayed filler layers. Despite a high layer thickness when applying the clear lacquer, the overall layer thicknesses of the multilayer lacquers produced according to the process according to the invention are very low. They are, in particular, of the order of 90 to 130 $\mu$m.

We claim:

1. A process for producing a multilayer lacquer coating comprising:

electrophoretically applying an electrophoretically depositable aqueous coating agent (I), which in a stoved state will produce an electrically conductive coating layer, onto an electrically conductive substrate, thereby forming a first coating layer;

stoving said first coating layer thereby forming an electrically conductive first coating layer;

electrophoretically applying onto said first coating layer, an electrophoretically depositable aqueous coating agent (II), which differs from said coating agent (I), thereby forming a second coating layer;

stoving said second coating layer thereby forming an electrically insulating second coating layer;

applying a third coating layer using a base coat coating agent, said base coat coating agent comprising at least one member selected from the group consisting of a color-giving coating agent and an effect-producing coating agent;

applying a fourth coating layer, comprising a transparent coating layer of a clear lacquer coating agent;

stoving said third coating layer and said fourth coating layer together; and optionally applying one or more further transparent coating layers;

wherein overall dry layer thickness of the multilayer lacquer coating is between 90 and 130 μm, and dry layer thickness of the at least one transparent coating layer is between 40 and 80 μm.

2. A process according to claim 1, comprising applying said multilayer lacquer coating to motor vehicles or motor vehicle parts.

3. A process according to claim 1, comprising applying an electro-dipcoat for producing the second coating layer, said electro-dipcoat having a color which is substantially similar to or the same as the color of the base coat coating agent used for producing the third coating layer.

4. A process according to claim 2, comprising applying an electro-dipcoat for producing the second coating layer, said electro-dipcoat having a color which is substantially similar to or the same as the color of the base coat coating agent used for producing the third coating layer.

5. A process according to claim 1, wherein dry layer thickness of the first coating layer is 5 to 15 μm, dry layer thickness of the second coating layer is 5 to 35 μm, and dry layer thickness of the third coating layer is 10 to 25 μm.

6. A process according to claim 1, comprising producing at least one of the transparent lacquer layers using a powder coating.

* * * * *

UNITED STATES PATENT AND TRADEMARK OFFICE

CERTIFICATE OF CORRECTION

PATENT NO. : 5,882,734

DATED : March 16, 1999

INVENTOR(S) : BLUM et al.

It is certified that error appears in the above-identified patent and that said Letters Patent is hereby corrected as shown below:

Column 7, line 20, change "1800° C" to --180° C--.

Signed and Sealed this

Seventh Day of September, 1999

*Attest:*

Q. TODD DICKINSON

*Attesting Officer*

*Acting Commissioner of Patents and Trademarks*